United States Patent [19]

Eliasson et al.

[11] Patent Number: 4,945,290

[45] Date of Patent: Jul. 31, 1990

[54] HIGH-POWER RADIATOR

[75] Inventors: Baldur Eliasson, Birmenstorf; Ulrich Kogelschatz, Hausen, both of Switzerland

[73] Assignee: BBC Brown Boveri AG, Baden, Switzerland

[21] Appl. No.: 260,869

[22] Filed: Oct. 21, 1988

[30] Foreign Application Priority Data

Oct. 23, 1987 [CH] Switzerland ..... 4156187

[51] Int. Cl.[5] ..... H01J 61/06

[52] U.S. Cl. ..... 315/246; 313/607; 313/631; 313/633; 313/637

[58] Field of Search ..... 315/246; 313/607, 631, 313/633, 637

[56] References Cited

U.S. PATENT DOCUMENTS 4,266,167 5/1981 Proud et al. ..... 315/248
4,427,921 1/1984 Proud et al. ..... 313/637 X
4,837,484 6/1989 Eliasson et al. ..... 313/634

FOREIGN PATENT DOCUMENTS 739064 3/1970 Belgium .
254111 1/1988 European Pat. Off. .

OTHER PUBLICATIONS

Journal of Applied Spectroscopy, vol. 41, No. 4, Oct. 1984, pp. 1194–1197; G. A. Volkova, et al.

*Primary Examiner*—Robert J. Pascal
*Attorney, Agent, or Firm*—Oblon, Spivak, McClelland, Maier & Neustadt

[57] ABSTRACT

The high-power radiator includes a discharge space (4) bounded by dielectrics (1, 2) and filled with a noble gas or gas mixture and electrodes (5, 6). The electrodes (5, 6) are transparent to the radiation produced by silent electrical discharges and are, situated on the surfaces of the di-electrics facing away from the discharge space. In this manner, a large-area UV radiator with high efficiency is produced which can be operated with high electrical power densities of up to 50 kW/m$^2$ of active electrode surface.

13 Claims, 1 Drawing Sheet

HIGH-POWER RADIATOR

FIELD OF THE INVENTION

The invention relates to a high-power radiator, in particular for ultraviolet light, having a discharge space filled with filling gas. The walls of the high-power radiator are formed by a first and a second dielectric which is provided with first and second electrodes on its surfaces facing away from the discharge space. A source of alternating current is connected to the first and second electrodes for feeding the discharge.

BACKGROUND OF THE INVENTION

The invention refers to a prior art such as emerges, for example, from the publication entitled "Vaccum-ultraviolet lamps with a barrier discharge in inert gases" by G. A. Volkova, N. N. Kirillova, E. N. Pavlovskaya and A. V. Yakovleva in the Soviet journal Zhuranl Prikladnoi Spektroskopii 41 (1984), No. 4,691–695, published in an English-language translation of the Plenum Publishing Corporation, 1985, Doc. no. 0021-9037/84/4104-1194, $08.50, pages 1194 ff.

For high-power radiators, in particular high-power UV radiators, there are various applications, such as, for example, sterilization, curing of lacquers and synthetic resins, flue gas purification, and destruction and synthesis of specific chemical compounds. In general, the wavelength of the radiator has to be very precisely matched to the intended process. The most well known UV radiator is presumably the mercury radiator, which radiates UV radiation of the wavelength 254 nm and 185 nm with high efficiency. In these radiators, a low-pressure low discharge is struck in a noble-gas/mercury vapour mixture.

The previously mentioned publication entitled "Vacuum ultraviolet lamps . . . " describes a UV radiation source based on the principle of the silent electrical discharge. This radiator comprises a tube of dielectric material with rectangular cross section. Two oppositely situated tube walls are provided with two-dimensional electrodes in the form of metal foils which are connected to a pulse generator. The tube is sealed at both ends and filled with a noble gas (argon, krypton or xenon). Under certain conditions, such filling gases form so-called excimers when an electrical discharge is struck. An excimer is a molecule which is formed from an excited atom and an atom in the ground state.

$$Ar + Ar^* \rightarrow Ar_2^*$$

It is known that the conversion of electron energy into UV radiation with these excimers takes place very efficiently. Up to 50% of the electron energy can be converted into UV radiation, the excited complexes living only for a few nanoseconds and emitting their bonding energy in the form of UV radiation when they decay. Wavelength ranges:

| Noble gas | UV radiation |
|---|---|
| $He_2^*$ | 60–100 nm |
| $Ne_2^*$ | 80–90 nm |
| $Ar_2^*$ | 107–165 nm |
| $Kr_2^*$ | 140–160 nm |
| $Xe_2^*$ | 160–190 nm |

In the known radiator, the UV light produced in a first embodiment penetrates the outside space via an endface window in the dielectric tube. In a second embodiment, the wide sides of the tube are provided with metal foils which form the electrodes. At the narrow sides, the tube is provided with cutouts over which special windows through which the radiation can emerge are glued.

The efficiency achievable with the known radiator is in the order of magnitude of 1%—that is to say, far below the theoretical value of around 50%, because the filling gas heats up unduly. A further inadequacy of the known radiator is to be seen in the fact that its light exit window has only a compartively small area for stability reasons.

European application 87109674.9 dated 6.7.1987, Swiss application 2924/86-8 dated 22.7.1986 or U.S. application Ser. No. 07/076926 dated 22.7.1986 proposed a high-power radiator which has a substantially greater efficiency, which can be operated with higher electrical power densities and whose light exit area is not subject to the restrictions mentioned. In addition, in the generic high-power radiator, both the dielectric and also the first electrodes are transparent to the said radiation, and at least the second electrodes are cooled. This high-power radiator can be operated with high electrical power densities and high efficiency. Its geometry can be matched, within wide limits, to the process in which it is used. Thus, in addition to large-area flat radiators, cylindrical ones which radiate inwards or outwards are also possible. The discharges can be operated at high pressure (0.1–10 bar). Electrical power densities of 1–50 $kW/m^2$ can be achieved with this construction. Since the electron energies in the discharge can be largely optimized, the efficiency of such radiators is very high, even if resonance lines of suitable atoms are excited. The wavelength of the radiation can be adjusted by means of the type of filling gas—for example, mercury (185 nm, 254 nm), nitrogen (337–415 nm), selenium (196, 204, 206 nm), xenon (119, 130, 147 nm), and krypton (124 nm). As in other gas discharges, the mixing of different types of gas is recommended.

The advantage of these radiators is in the two-dimensional radiation of large radiation powers with high efficiency. Almost the entire radiation is concentrated in one or a few wavelength ranges. In all cases, an important feature is that the radiation can emerge through one of the electrodes. This problem can be solved with transparent, electrically conducting layers or, alternatively, also by using, as the electrode, a fine-mesh wire gauze or deposited conductor tracks which, on the one hand, ensure the supply of current to the dielectric, but which on the other hand, are largely transparent to the radiation. It is also possible to use a transparent electrolyte (for example, $H_2O$) as a further electrode, and this is advantageous for the irradiation of water/sewage since, in this manner, the radiation produced penetrates the liquid to be irradiated directly, and this liquid also serves as coolant.

Such radiators radiate only in a solid angle of 2 $\pi$. Since, however, every element of volume situated in the discharge gap radiates in all directions (i.e., in a solid angle of 4 $\pi$) one half of the radiation is initially lost in the radiator described above. It can be partially recovered by skillfully fitting mirrors, as was already proposed in the reference cited. In this connection, two things have to be borne in mind:

any reflecting surface has, in the UV range, a coefficient of reflection which may be markedly less than 1; and the radiation thus reflected has to pass three times through the absorbing quartz glass.

OBJECT OF THE INVENTION

The invention is based on the object of providing a high-power radiator which can be operated with high electrical power densities, has a maximum light exit surface, and, in addition, makes possible an optimum utillization of the radiation.

SUMMARY OF THE INVENTION

This object is achieved, according to the invention, in that, in a generic high-power radiator, both the dielectrics and also the electrodes are transparent to the radiation.

The radiating gas, which is excited by a silent discharge, fills the gap, which is up to 1 cm wide, between two dielectric walls (composed, for example, of quartz). The UV radiation is able to leave the discharge gap in both directions, which doubles the radiation energy availabe and, consequently, also the efficiency. The electrodes may be formed as a relatively wide-mesh grid. Alternatively, the grid wires may be embedded in quartz. This would, however, have to take place so that the UV transparency of the quartz is not substantially impaired. A further variation of the construction would be to deposit an electrically conducting layer which is transparent to UV instead of the lattice.

BRIEF DESCRIPTION OF THE DRAWINGS

The drawing shows diagrammatically exemplary embodiments of the invention. In particular.

DETAILED DESCRIPTION OF THE PRESENTLY PREFERRED EMBODIMENTS

The First Embodiment

Figure 1:
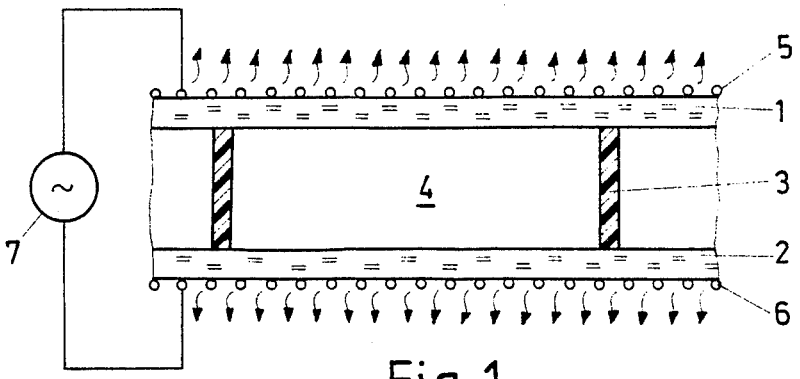
FIG. 1 shows an exemplary embodiment of the invention in the form of a flat two-dimensional radiator.

The panel-type UV high-power radiator in FIG. 1 comprises essentially two quartz or sapphire panels 1, 2 which are separated from each other by spacers 3 of insulating material and which delineate a discharge space 4 having a typical gap width between 1 and 10 mm. The outer surfaces of the quartz or sapphire panels 1, 2 are provided with a relatively wide-mesh wire gauze 5, 6 which forms the first and second electrode respectively of the radiator. The electrical supply of the radiator takes place by means of a source of alternating current 7 connected to these electtrodes.

As a source of alternating current 7, it is generally possible to use those which have been used for a long time in conjunction with ozone generators and which have the frequencies, normal in that case, of between 50 Hz and few kilohertz.

The discharge space 4 is laterally sealed in the usual manner, and it is evacuated before sealing and filled with an inert gas, or a substance which forms excimers under discharge conditions—for example mercury, noble gas, and noble gas/metal vapour mixture, noble gas/halogen mixture, optionally using an additional further noble gas (Ar, He, Ne) as buffer gas.

In this connection, depending on the desired spectral composition of the radiation, a substance according to the table below may be used:

| Filling gas | Radiation |
|---|---|
| Helium | 60–100 nm |
| Neon | 80–90 nm |
| Argon | 107–165 nm |
| Xenon | 160–190 nm |
| Nitrogen | 337–415 nm |
| Krypton | 124 nm, 140–160 nm |
| Krypton + fluorine | 240–255 nm |
| Mercury | 185, 254 nm |
| Selenium | 196, 204, 206 nm |
| Deuterium | 150–250 nm |
| Xenon + fluorine | 400–550 nm |
| Xenon + chlorine | 300–320 nm |

In the silent discharge which forms (dielectric barrier discharge), the electron energy distribution can be optimized by varying the gap width (up to 10 mm) of the discharge space, the pressure (up to 10 bar), and/or the temperature.

For very short wave radiations, panel materials such as, for example, magnesium fluoride and calcium fluoride are also suitable. For radiators which are intended to yield radiation in the visible light range, the panel material is glass. Instead of a wire gauze, a transparent, electrically conducting layer may be present, it being possible to use a layer of indium oxide or tin oxide for visible light, a 50–100 angstrom thick gold layer for visible and UV light, and also a thin layer of alkali metals specifically in the UV.

The Second Embodiment

Figure 2:
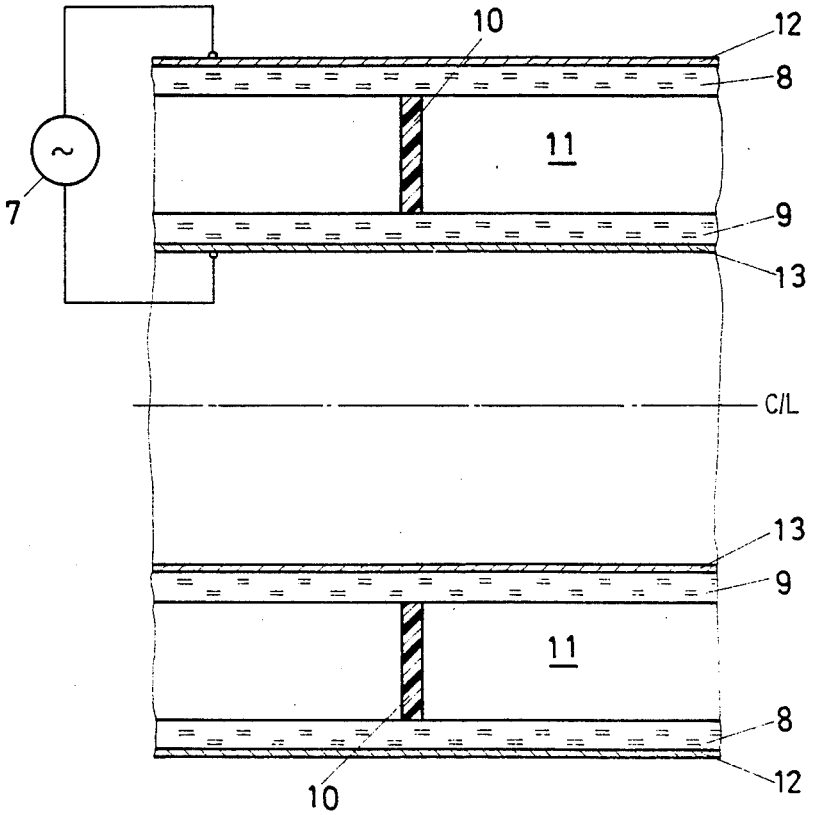
FIG. 2 shows a cylindrical radiator radiating outwards and inwards and having radiation-transparent two-dimensional electrodes.

In the exemplary embodiment in FIG. 2, a first quartz tube 8 and a second quartz tube 9 at a distance from the latter are coaxially arranged inside each other and spaced by means of annular spacing elements 10 made of insulating material. An annular gap 11 between the tubes 8 and 9 forms the discharge space. A thin UV-transparent, electrically conducting layer 12 (for example, of indium oxide or tin oxide or alkali metal or gold) is provided on the outside wall of the outer quartz tube 8 as the first electrode, and an identical layer 13 on the inside wall of the inner glass tube 9 is provided as the second electrode. Like the exemplary embodiment in FIG. 1, the discharge space is filled with a substance or mixture of substances in accordance with the above table.

Here too, depending on the wavelength of the radiation, other electrode materials and electrode types may be used such as were mentioned in conjunction with FIG. 1.

The radiators described are excellently suitable as photochemical reactors with high yield. In the case of the flat radiator, the reacting medium is fed past the front face or the rear face of the radiator. In the case of the round radiator, the medium is fed past both on the inside and on the outside.

The flat radiators may be suspended (for example, as "UV panels") in the waste gas chimneys of dry cleaning plants and other industrial plants in order to destroy solvent residues (for example, chlorinated hydrocarbons). Similarly, a fairly large number of such "round radiators" can be combined to form fairly large arrays and used for similar purposes.

Improvements can also be achieved if the UV radiators radiating on one side are mirror-coated according to the patent application mentioned in the introduction. The abovementioned passage through the absorbing quartz walls three times can be avoided if the UV mirror coating (for example, aluminium) is applied on the inside and then covered with a thin layer of magnesium fluoride ($MgF_2$). In this manner, the radiation would always have to pass through only one quartz wall.

We claim:

1. A high-power radiator for ultraviolet light, said high-power radiator comprising:
   (a) a first dielectric having a first side and a second side;
   (b) a second dielectric having a first side facing but spaced from the first side of said first dielectric to form a discharge space therebetween and a second side;
   (c) a first electrode located on the second surface of said first dielectric;
   (d) a second electrode located on the second surface of said second dielectric;
   (e) a filling gas located in said discharge space; and
   (f) a source of alternating current connected to said first and second electrodes,
   (g) wherein said first dielectric, said second dielectric, said first electrode, and said second electrode are all transparent to radiation from said filling gas.

2. A high-power radiator as recited in claim 1 wherein said first and second electrodes are transparent, electrically conducting layers.

3. A high-power radiator as recited in claim 2 wherein said layers are formed of a material selected from the group consisting of indium oxide, tin oxide, alkali metal, and gold.

4. A high-power radiator as recited in claim 1 wherein said first and second electrodes are composed of metallic wires which are arranged on or in said first and second dielectric, respectively.

5. A high-power radiator as recited in claim 1 wherein said first and second electrodes are formed as wire gauze.

6. A high-power radiator as recited in claim 1 wherein:
   (a) said filling gas includes a noble gas or a mixture of noble gases and
   (b) said filling gas forms excimers under discharge conditions.

7. A high-power radiator as recited in claim 1 wherein said filling gas includes a gas selected from the group consisting of mercury, nitrogen, selenium, deuterium, and mixtures of these gases alone or with a noble gas.

8. A high-power radiator as recited in claim 1 wherein said first and second dielectrics are at least generally planar panels.

9. A high-power radiator as recited in claim 1 wherein said first and second dielectrics are at least generally concentric tubes.

10. A high-power radiator as recited in claim 1 wherein said filling gas is a noble gas/halogen mixture.

11. A high-power radiator as recited in claim 10 wherein said noble gas/halogen mixture is selected from Ar/F, Kr/F, Xe/Cl, Xe/I, and Xe/Br.

12. A high-power radiator as recited in claim 10 wherein said filling gas contains a buffer gas in the form of an additional noble gas.

13. A high-power radiator as recited in claim 12 wherein said additional noble gas is selected from the group consisting of argon, helium, and neon.

* * * * *